US005857721A

United States Patent [19]

Liroff

[11] Patent Number: 5,857,721

[45] Date of Patent: Jan. 12, 1999

[54] CARGO SEAL

[76] Inventor: Jeff Liroff, 3140 Paddock Rd., Fort Lauderdale, Fla. 33331

[21] Appl. No.: 801,843

[22] Filed: Feb. 18, 1997

[51] Int. Cl.[6] ..... B65D 27/30; E05B 65/06

[52] U.S. Cl. ..... 292/307 R; 292/321; 292/DIG. 32

[58] Field of Search ..... 292/317, 318, 292/319, DIG. 32, 307 R, 321, 323, 324

[56] References Cited

U.S. PATENT DOCUMENTS

| | | | |
|---|---|---|---|
| 446,653 | 2/1891 | Wheeler | 292/321 |
| 1,356,976 | 10/1920 | Exley et al. | 292/321 |
| 2,745,362 | 5/1956 | Lunde | 105/377.07 |
| 2,796,277 | 6/1957 | Brooks et al. | 292/307 |
| 4,299,417 | 11/1981 | McClure | 292/320 |
| 4,389,862 | 6/1983 | Hastings | 292/DIG. 32 |
| 4,564,230 | 1/1986 | Haist | 292/DIG. 32 |
| 4,889,372 | 12/1989 | Dege et al. | 292/DIG. 32 |
| 5,118,149 | 6/1992 | Emmons | 292/327 |
| 5,337,503 | 8/1994 | Goby | 292/318 X |
| 5,388,435 | 2/1995 | Bailey | 292/100 X |
| 5,553,904 | 9/1996 | Lorenzo | 292/DIG. 32 |
| 5,582,447 | 12/1996 | Leon et al. | 292/324 X |
| 5,647,620 | 7/1997 | Kuenzel | 292/317 |

*Primary Examiner*—Kenneth J. Dorner
*Assistant Examiner*—Robert G. Santos
*Attorney, Agent, or Firm*—Malloy & Malloy, P.A.

[57] ABSTRACT

An improved cargo seal structured to securely close a container having at least one door, the cargo seal including a lock assembly, including at least one lock aperture, that secures the door in a closed orientation, and an elongate segment of substantially strong, generally flexible material. The elongate segment is structured to extend through the lock aperture of the lock assembly so as to restrict movement and/or actuation of the lock assembly, and is sufficiently elongate to extend across the doors and thereby prevent opening thereof. A pair of lock segments are further provided and are correspondingly disposed at a first end and a second end of the elongate segment, at least one of the lock segments being structured to be securely coupled with at least one mating segment at the first end of the elongate segment. Each of the lock segments has an increased diameter relative to a diameter of the elongate segment at its first end and second end so as to prevent removal of the elongate segment from the lock aperture by passage over the first end and the second end of the elongate segment. Moreover, each of the lock segments further includes an identifying indicia disposed thereon so as to prevent its unauthorized replacement.

14 Claims, 6 Drawing Sheets

FIG. 4
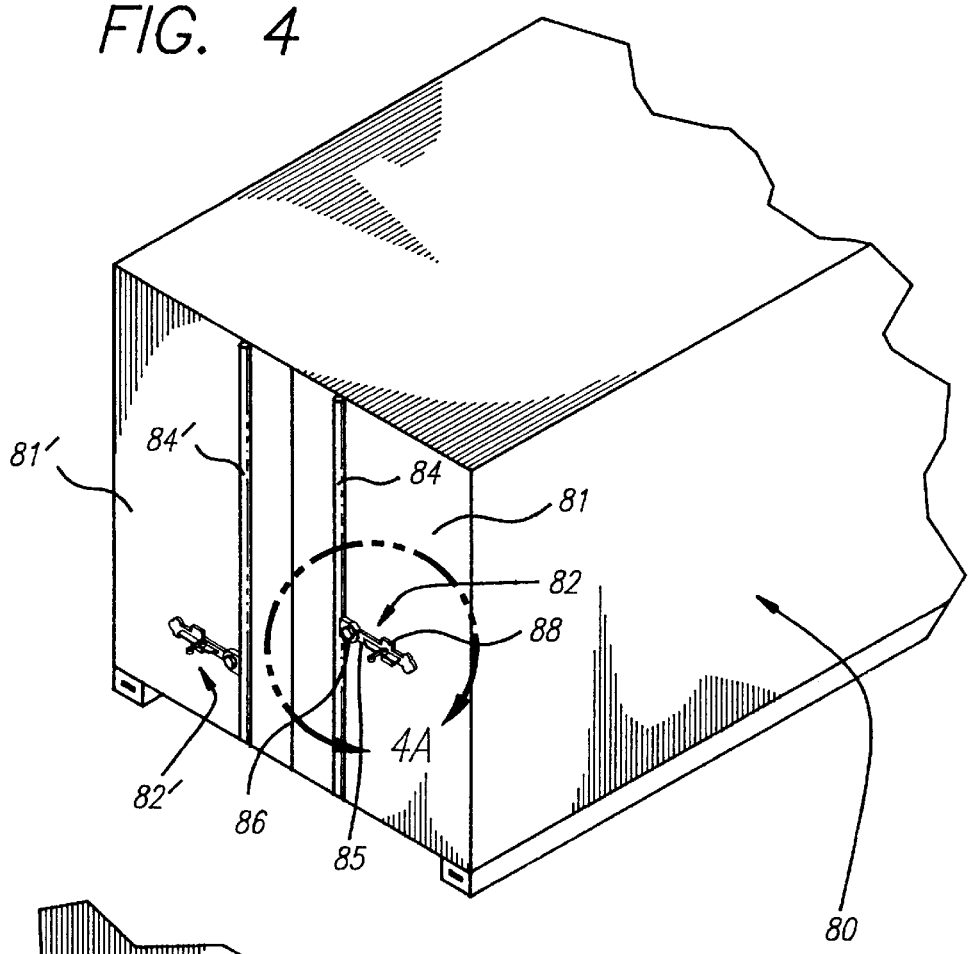
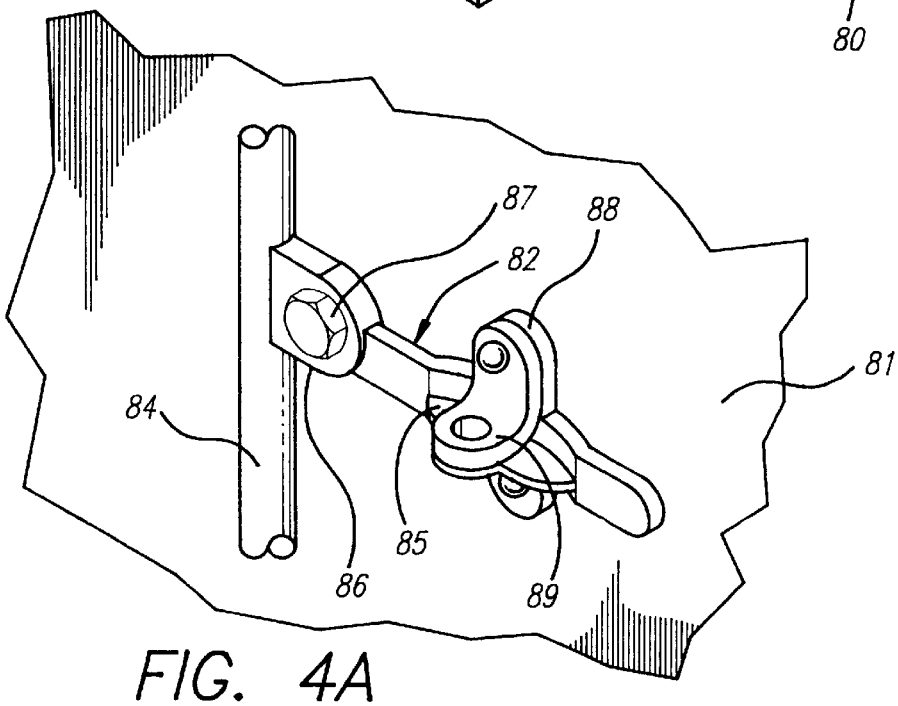
FIG. 4A

FIG. 5
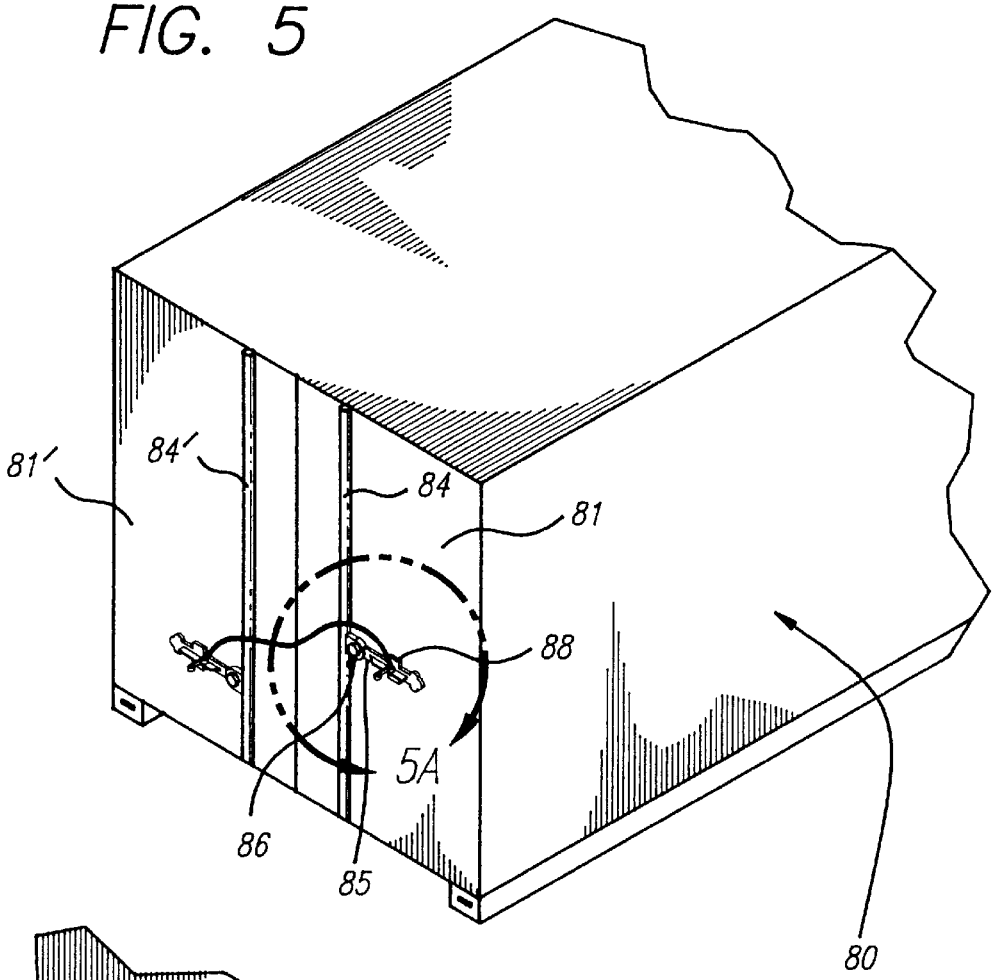
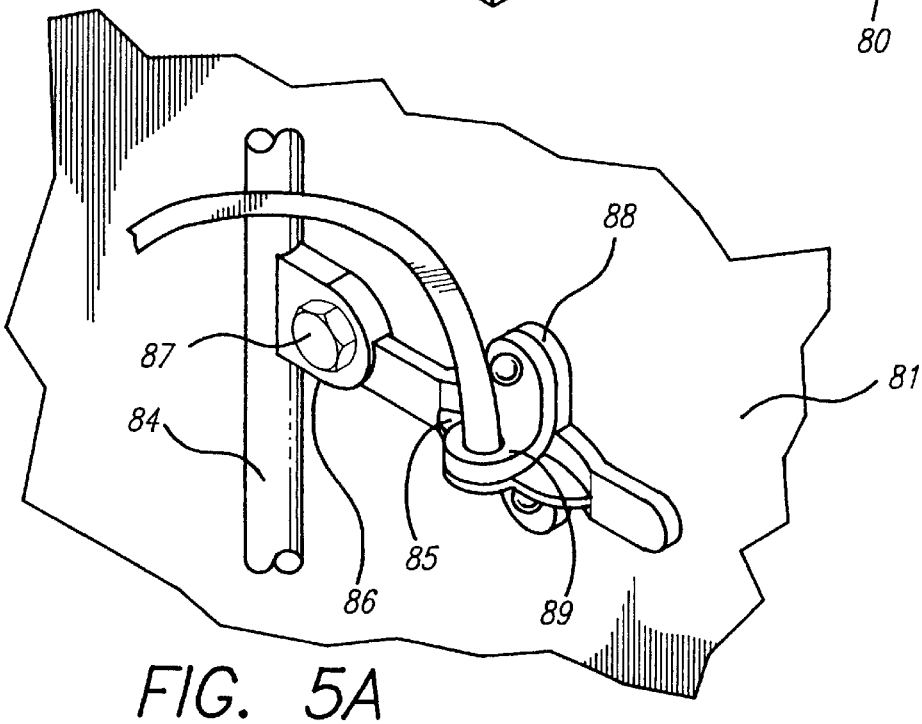
FIG. 5A

CARGO SEAL

BACKGROUND OF THE INVENTION

1. Field of the Invention

The present invention is directed towards an improved cargo seal which is structured to be utilized on a cargo container in order to maintain the cargo container's doors securely locked in a closed orientation, preventing opening thereof without destructively removing the cargo seal and door lock in a manner which clearly indicates tampering has occurred, even if the lock is replaced, thereby substantially protecting the contents of the cargo container, while also substantially identifying when tampering has occurred.

2. Description of the Related Art

Large, cargo containers, such as those that are detachable or are formed as part of trailers are the most commonly used means of transporting large volumes of many varying cargos from location to location around the world. A primary advantage to their use is that the large containers can store large quantities of goods and can be effectively transported on boats, trains, and/or trucks in order to expeditiously arrive at their eventual destination. The detachability and adaptability of containers is of particular importance because the containers will often change hands from one carrier to another carrier, such as from a train to a truck or from a trucking company to a steamship line, during the various legs of a transport route.

Naturally, due to the great volume and often valuable nature of the cargos being transported in the large containers, security is an important consideration when dealing with cargo transportation. Unfortunately, however, one of the most prevalent security concerns, in addition to the third party hijackers or thieves who do not generally care if they leave signs of a break in, involves internal not obviously detectable theft. For example, it is sometimes an all too common occurrence that during transit, an individual placed in custody of the container, such as a truck driver in charge of transporting the cargo from point to point, is behind a robbery. Such an individual is naturally very familiar with the nature of the cargo on board, and can easily arrange for a safe rendezvous for the removal of all or part of the cargo contained within the large container. Unlikely as it may seem, in these instances, it is often the security measures and/or locks which are normally employed that serve as the biggest ally to the thieves.

A conventional, single-use, single end seal is the common article used to secure the door handle/latch in a door closing orientation. Nevertheless, thieves have still found ways to unlatch the doors without actually braking the seal. Specifically, the joint between the actuation handle and the lock rod on most conventional containers generally incorporates a single bolt securing both elements with one another. As a result, a thief can merely cut or drill out and remove that bolt to permit the independent turning of the lock rod while the actuation handle remains in place, thereby opening the container without having to move the actuation handle or break the seal. Once the cargo has been removed and the door is re-closed, a replacement bolt is merely inserted to connect the actuation handle with the lock rod, and can be painted over if necessary to preserve the original appearance. As a result, the conventional type identifying seal has never been removed and no evidence of tampering is available as the cargo changes hands from one carrier to another. Accordingly, when the specific carrier involved in the theft arrives at a next leg of the transport, the container looks normal and intact, and the responsibility is passed on to the next transport carrier. Naturally, when the theft is ultimately discovered blame passes from carrier to carrier with no concrete resolution as to the true thieves or the actual stage of transport during which the theft occurred. Moreover, as no positive blame can be put on any particular carrier, it is often the owner of the cargo who must take the loss and must fight their insurance company for some recovery.

Despite the numerous techniques thieves have found to defeat existing systems, and because of the high volume of cargo being transported on a daily basis, and the cost of more extensive security measures, most carriers still utilize the above-described securing methods to seal the cargo doors. Such carriers accept a certain percentage of losses to theft as an expense of doing business given the lack of a viable alternative. Accordingly, it would be highly beneficial to provide a cargo container seal and door lock which can defeat or at least significantly hinder the "inside job" theft in a cost effective and easy to implement fashion. Such an improved seal should be structured so as to resist opening of the doors without its removal, and should be difficult to replace without providing substantially clear and noticeable evidence of tampering, thereby allowing the identification of a theft by a transport company when they take on the cargo.

For these reasons, some shippers have turned to utilizing single use locking brackets which employ common single use, single end seals which bear a particular, recorded serial number thereon if added security is desired. Accordingly, when the cargo container changes hands from one carrier to another the lock is inspected and the numerals on the seal(s) are recorded to ensure that they match the shipping records. Still, however, while such techniques are more effective than the security measures which had previously been available, clever thieves have quickly found ways around those procedures as well.

Specifically, because a thief associated with a transport attendant may have extended time and can choose a location for a theft to occur, techniques not usually available to the common thief can be employed. In particular, a thief, usually equipped with a blowtorch, will first cut the bracket between the two doors at a central point thereof, thereby permitting the free movement of the doors relative to one another. If an independent bracket seal is used to keep the bracket secured in place, such cutting of the bracket does not remove or damage the seal which keeps the bracket in place, and accordingly, when the theft is completed, the thieves can merely weld the two sections of the bracket back together. Further, a rapid coat of silver paint is usually sufficient to match the normal zinc coated finish of the bracket and completely mask that the bracket has been removed. Alternatively, if as in most instances the bracket is merely locked or welded in place, a new bracket can be replaced on the closed doors as it is only the bracket which restricted opening of the container.

As such, it would be beneficial to provide an improved seal that is structured to require its actual removal in order to access the container. Such a seal, which prior to the present invention has not been provided, should be structured to be permanently and noticeably damaged if broken and/or removed, and should be difficult to duplicate easily and effectively.

Specifically, existing cargo seals only include a single lock head bearing a serial number and providing for independent attachment. Such seals require a thief to duplicate a single serial number on the spot, and are structured only to seal a single door latch such that removal of a bolt from the closure assembly and actuation of the door without removal of the seal can be easily achieved. Indeed, conventional seals are structured only to maintain the latch closed and not to actually maintain the door closed. Moreover, if an improved tamper evident container door lock that shrouds the joints of the closure assembly and secures both doors in a closed orientation is utilized, existing seal configurations are not structured to sufficiently enhance the closure array.

SUMMARY OF THE INVENTION

The present invention is directed towards an improved cargo seal to be utilized to securely close a container having at least one door. Specifically, the cargo seal includes a lock assembly structured to secure the door in a closed orientation and including at least one lock aperture. The lock aperture is disposed preferably to extend through mating portions of the lock assembly which if secured to one another will prevent manipulation of the lock assembly to permit movement of the doors into an open orientation.

Moreover, the improved cargo seal includes an elongate segment formed of a substantially strong, generally flexible material. The elongate segment, which includes a first end and a second end is structured to extend through the lock aperture of the lock assembly in order to restrict movement of the lock assembly into an orientation that will permit opening of the doors.

Disposed at a first end of the elongate segment is a mating segment. Further, a pair of lock segments are provided, the lock segments being correspondingly disposed at the first end and the second end of the elongate segment. At least one of the lock segments, however, is structured to be securely coupled with the mating segment of the first end of the elongate segment. As such, the lock segment and mating segment can be secured with one another after the elongate segment is passed through the lock aperture. Additionally, each of the lock segments includes an increased diameter relative to a diameter of the elongate segment at the first end and the second end. As such, the lock segments prevent removal of the elongate segment from the lock aperture by passage over the first end or the second end of the elongate segment.

It is an object of the present invention to provide an improved cargo seal structured to be secured to a cargo container door in such a manner as to prevent opening of the cargo container doors without its actual removal.

Yet another object of the present invention is to provide an improved cargo seal which is capable of being utilized with a tamper evident cargo container door lock of the type which shrouds and conceals a container door closure assembly.

A further object of the present invention is to provide an improved cargo seal having multiple and independent identifying indicia disposed thereon in order to increase the difficulty associated with unnoticeably replacing a removed cargo seal.

Still an object of the present invention is to provide a cargo seal which cannot be removed without noticeably breaking the seal, and whose removal is required in order to open the cargo container doors.

An additional object of the present invention is to provide an cargo seal capable of being independently secured and locked at opposite ends thereof so as to facilitate utilization in confined areas.

BRIEF DESCRIPTION OF THE DRAWINGS

For a fuller understanding of the nature of the present invention, reference should be had to the following detailed description taken in connection with the accompanying drawings in which:

FIG. 4 is a perspective view of a rear door of a cargo container.

FIG. 4A is a isolated, closeup view of the closure assembly of the cargo container illustrated in FIG. 4.

FIG. 5 is a perspective view of the seal assembly of the present invention with the lock assembly including the cargo door closure assembly.

FIG. 5A is an isolated, closeup view of the engagement of the elongate segment with the closure assembly of FIG. 5.

Like reference numerals refer to like parts throughout the several views of the drawings.

DETAILED DESCRIPTION OF THE PREFERRED EMBODIMENT

Figure 1:
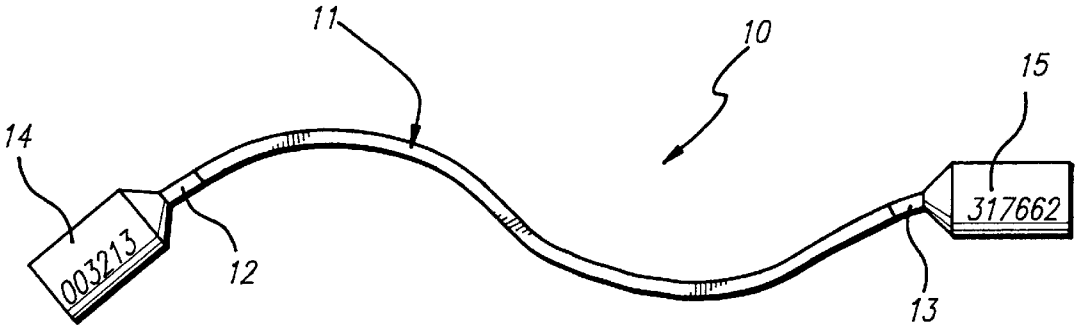
FIG. 1 is a perspective view of the improved cargo seal of the present invention.
Figure 2:
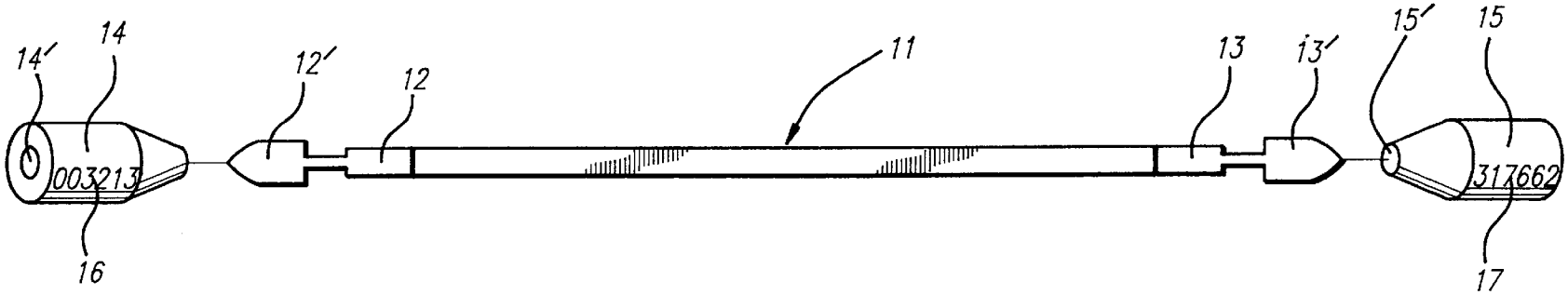
FIG. 2 is an exploded view of the improved cargo seal of the present invention.

The present invention is directed towards an improved cargo seal, generally indicated as 10. Specifically, the cargo seal is structured for use on a cargo container 80 of the type that typically includes a pair of doors 81 and 81' secured in a closed orientation by a lock assembly, and is structured to provide added security against unauthorized opening of the doors in a highly tamper evident manner should a break-in be attempted and/or achieved. As such, an individual transport carrier will be able to effectively inspect the cargo container 80 before accepting custody and can more readily identify a prior break in. The cargo container 80 itself can either be of a detachable kind or can be included as part of a trailer.

In particular, the cargo seal 10 of the present invention includes an elongate segment 11 formed of a substantially strong, yet flexible material. In the preferred embodiment, the elongate segment 11 is formed of braided or bound metal strands which are generally secured together at opposite ends thereof to form a very strong durable segment. Moreover, as a plurality of individual strands are utilized to makeup the preferred elongate segment 11, some flexibility is achieved and if the elongate segment 11 is cut inappropriately, the quantity of strands are such that the elongate segment 11 cannot be unnoticeably returned to its original form. Furthermore, the elongate segment 11 is preferably of a sufficient thickness such that it will be substantially difficult to quickly and easily cut the elongate segment 11.

The elongate segment 11 includes a first end 12 and a second end 13 which are preferably sufficiently spaced apart from one another so as to extend between the adjacent doors 81 and 81' of the cargo container 80, if necessary, and particularly so as to extend across the mating edges of the doors. Moreover, at least a first end 12 of the elongate segment 11, but preferably both the first end 12 and the second end 13 of the elongate segment 11 include a mating segment 12' and 13'. The mating segments 12' and 13' are structured and disposed to be securely coupled with a pair of lock segments 14 and 15 correspondingly disposed at the first end 12 and second end 13 of the elongate segment 11. Although one of the lock segments may be integrally formed with and/or previously secured at a corresponding end of the elongate segment 11, it is preferred that both lock segments 14 and 15 be separate segments that can be independently coupled with the corresponding mating segments 12' and 13' at the first and second ends 12 and 13 of the elongate segment 11. As such, substantially facilitated positioning and engagement of the elongate segment with a lock assembly can be more effectively achieved. In use, the mating segments 12' and 13' are correspondingly introduced into an axial aperture 14' and 15' of the lock segments 14 and 15. Because a diameter of the mating segment 12' and 13' is slightly larger than a diameter of the axial aperture 14' and 15' of the lock segments 14 and 15, some force is required to introduce the mating segments 12' and 13'. Once introduced, however, removal of the mating segments 12' and 13' is not possible, unless it is actually drilled out from the lock segment 14 and 15, a procedure which is not only difficult, but is very noticeable if the lock segment is replaced to try to cover tampering. In this regard, in the preferred embodiment the mating segments 12' and 13' define male lock portions with the lock segments 14 and 15 defining female lock portions. Of course, an alternative male/female configuration could be incorporated if necessary, so long as a secure, fixed, interconnection therebetween is achieved. Preferably, however, the lock segments 14 and 15 include an increased diameter relative to the elongate segment 11, and as such, it is more practical for the lock segments to define a female lock portion.

Included on each of the lock segments 14 and 15, is identifying indicia 16 and 17. Specifically, the identifying indicia 16 and 17 is disposed on the lock segments 14 and 15 in such a manner as it cannot be conveniently duplicated on site. Moreover, the identifying indicia on each of the lock segments 14 and 15 is preferably different from the other, thereby requiring a thief to identify and replace both lock segments 14 and 15 with correct identifying indicia 16 and 17 if tampering is to be effectively concealed. Indeed, in one of the preferred embodiments as will be illustrated subsequently, the lock segment 14 will generally be disposed in a concealed region such that it may be difficult to access and/or see the identifying indicia prior to removal.

The improved cargo seal of the present invention further includes a lock assembly. Specifically, the lock assembly is structured to secure the doors 81 and 81' of the cargo container in the closed orientation and further includes at least one lock aperture. Specifically, the lock aperture will be positioned as part of the lock assembly in such a manner that the elongate segment 11 may extend therethrough. Moreover, the lock aperture is preferably sized a substantially equivalent diameter as the elongate segment 11 such that the lock segments 14 and 15, which have an increased diameter as compared with the elongate segment 11 may not pass therethrough and thereby the elongate segment 11 may not be removed from the lock aperture over the first or second ends of the elongate segment 11.

In a first embodiment, as in FIGS. 4, 4A, 5, & 5A, the lock assembly includes a container closure/door latch assembly 82. The closure assembly 82 is preferably of the type that includes at least one lock rod 84 and 84' on each door 81 and 81' to maintain the doors secured in a closed orientation. Moreover, connected with each of the lock rods 84 and 84' is an actuation handle 85 which permits appropriate maneuvering of the lock rod 84 to latch and un-latch the door 81. In particular, a first one of the doors 81 is generally the main door which holds the other, second door 81' closed until it is moved. The actuation handle 85 of that main door 81 generally rests within a bracket 88 where it can be locked or sealed in place. Typically, the bracket 88, which holds the actuation handle 85 in its door closing orientation so that the lock rod 84 maintains the door 81 latched, includes a lock flange 89 which extends down onto the actuation handle 85. The lock flange 89 and actuation handle include the lock apertures 85' and 89' structured and disposed to receive the elongate segment 11 therethrough to secure the actuation handle 85 in the bracket 88 and in its generally flat engagement along the door 81 which maintains the lock rod 84 in a door latching orientation. Specifically, the actuation handle 85 itself is generally connected to the lock rod 84 at a connection joint 86 disposed therebetween. In particular, the connection joint 86 is welded and/or otherwise integrally secured with the lock rod 84, and generally includes a large bolt 87 extending therethrough and into the actuation handle 85. Accordingly, with the actuation handle 85 secured to the lock rod 84 at the connection joint 86, upon pulled movement of the actuation handle 85 away from the door 81 and into a generally perpendicular orientation, the lock rod 84 will also rotate and can be moved to unlatch the door 81 from its closed orientation. By introducing the elongate segment 11 through the lock apertures 85' and 89', movement of the handle 85 is prevented without removal of the elongate segment. Moreover, as the elongate segment is of an extended length, it may be introduced through the corresponding lock apertures of the second closure assembly 82' on the second door 81' to define one sealed position of the elongate element 11. As such, even if the doors can be unlocked without actuating the handles, the elongate segment extends across the doors 81 and 81' such that they cannot actually be opened. This added measure prevents disengagement of the handles from the lock rods to provide for opening of the doors.

Figure 3:
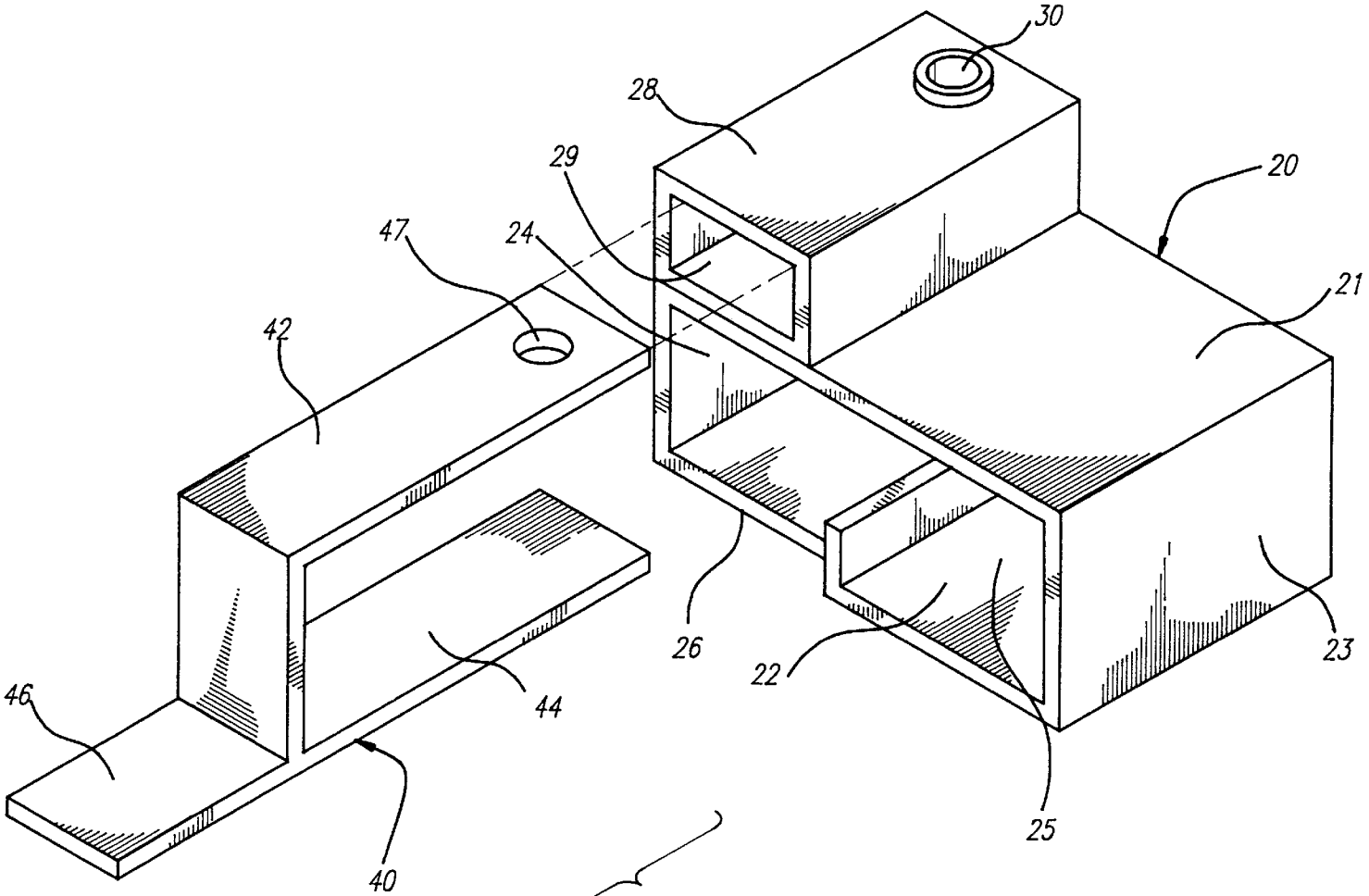
FIG. 3 is an isolated, exploded view of the tamper evident container door assembly to be utilized as part of e improved cargo seal of the present invention.
Figure 6:
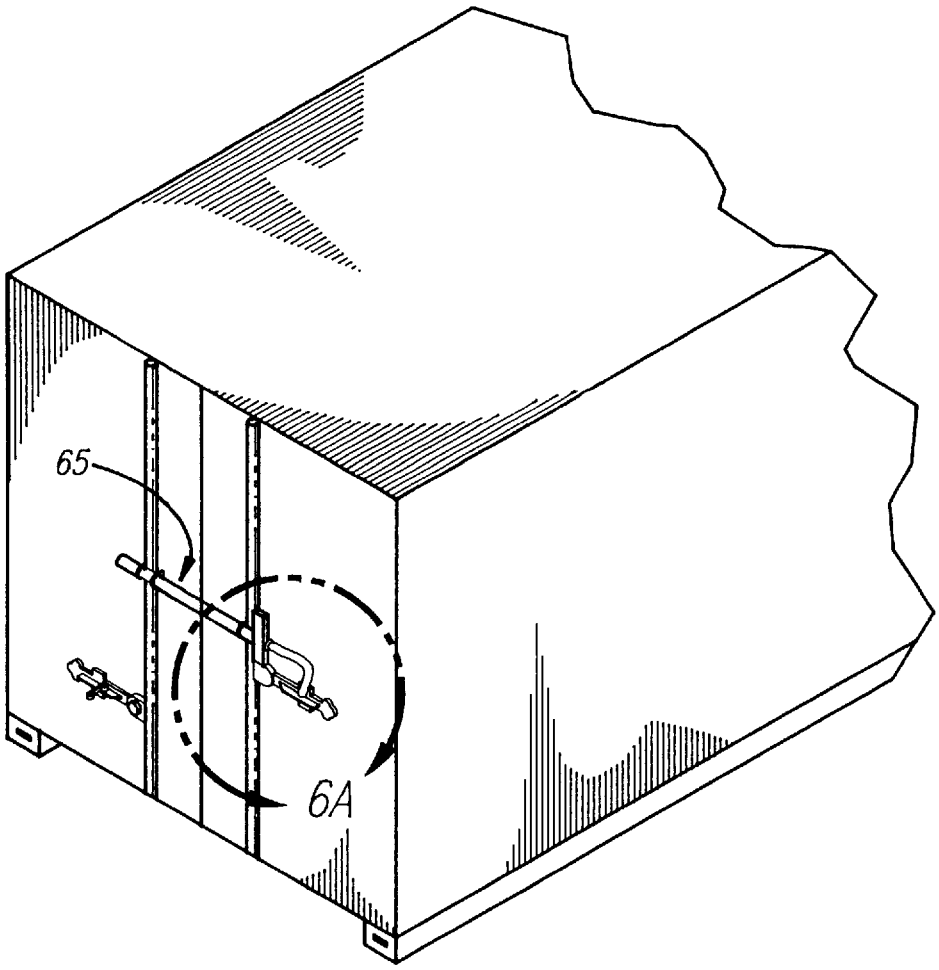
FIG. 6 is a perspective view of the elongate segment of the present invention connected with a tamper evident container door lock.
Figure 6A:
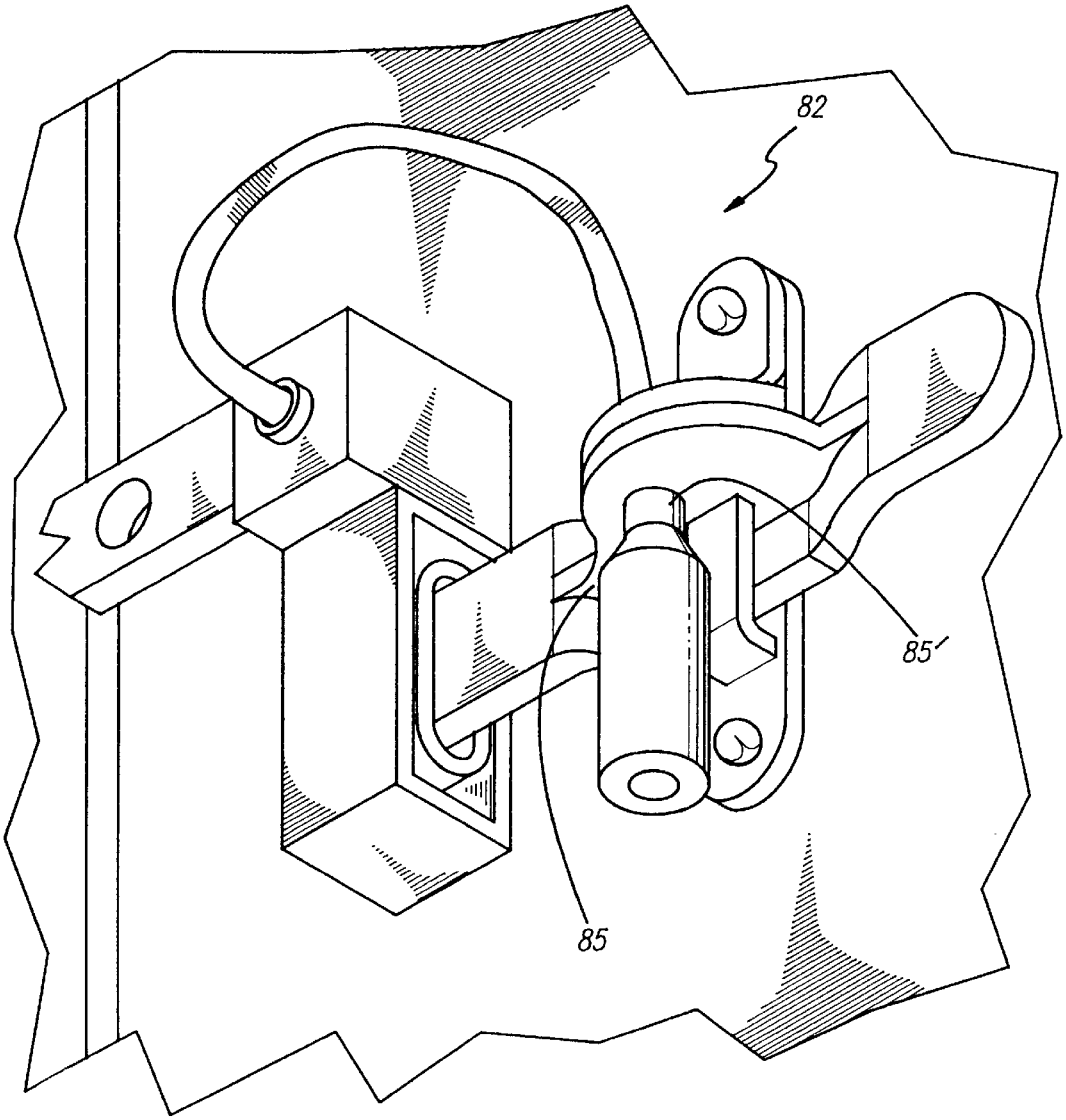
FIG. 6A is an isolated view of the engagement illustrated in FIG. 6.

In another embodiment, as illustrated in FIGS. 3, 6 & 6A, instead of or in addition to the door latch closure assembly 82, the lock assembly may include a tamper evident cargo container door lock. The preferred tamper evident container door lock of the present invention includes a primary shroud assembly 20. The primary shroud assembly 20 is formed of a substantially strong, cut resistant metal, such as steel, and will be configured such that it must be cut by a blowtorch, or a similar high power cutting device, to be removed. Further, the primary shroud assembly 20 is structured to substantially cover and shield from external access the connection joint 86 between the actuation handle 85 and the lock rod 84 of the cargo door closure assembly. As such, the primary shroud assembly 20 will substantially prevent access to the connection joint unless it is removed.

In the preferred embodiment of the container door lock, the primary shroud assembly 20 includes a front face 21, a rear face 22 and a pair of opposite side faces 23 and 24, which define an open interior 25 through which the actuation handle 85 extends. Further, although the primary shroud assembly 20 need not be completely enclosed, in the preferred embodiment, it will include a substantially tubular configuration to wrap completely about the actuation handle 85 and thereby more effectively restrict removal of the primary shroud assembly 20 from the actuation handle 85 unless it is cut or slid off of the free end of the actuation handle 85, which cannot occur without freeing the actuation handle 85 from the lock flange 89 and can only be accomplished by breaking or removing the container seal or padlock. Moreover, by substantially enclosing and encasing the actuation handle 85 and connection joint 86, vertical movement of the primary shroud assembly 20, and therefore the door lock, relative to the lock rod 84 and actuation handle 85 is restricted.

In addition to substantially covering and concealing the connection joint 86, the primary shroud assembly 20, as illustrated in the figures, is structured with a substantially narrow open interior 25. As such, minimal spacing exists between an interior wall surface of the primary shroud assembly 20 and the connection joint 86, and access to the connection joint 86 through an open side of the primary shroud assembly 20, such as by bolt cutters, a wrench, or a torch is substantially restricted. Accordingly, the connection joint 86 cannot be detached from the actuation handle 85, so as to permit independent movement of a lock rod 84 relative to the actuation handle 85, without moving or removing the primary shroud assembly 20.

The tamper evident cargo container door lock of the present invention further includes a pivot brace 40. The pivot brace 40 is structured to engage the primary shroud assembly 20, and be secured thereto, in order to prevent pivotal movement of the primary shroud assembly 20 about an axis of the lock rod 84. As such, given that the primary shroud assembly 20 encases the actuation handle 85, the actuation handle 85 cannot be pivoted away from the container door 81 into a lock rod unlatching orientation. Moreover, even if the actuation handle 85 were somehow released or detached from the connection joint 86, as the primary shroud assembly 20 extends over and encases the connection joint 86, which is welded or otherwise integrally formed with the lock rod 84, the secure engagement of the primary shroud assembly 20 with the pivot brace 40 functions to resist pivotal rotation of the lock rod 84 itself into a releasable orientation.

In the preferred embodiments, the pivot brace 40 is structured to extend or wrap about the lock rod 84 and into secure engagement with the primary shroud assembly 20. As such, once secured with one another the primary shroud assembly 20 cannot be slid along the length of the actuation handle 85 to expose the connection joint 86, and the pivot brace 40 cannot slide vertically. In this regard, in the embodiment of FIG. 4, the pivot brace 40 includes a generally C-shaped clasping region having upper and lower elongate engagement segments 42 and 44 which extend about the lock rod 84 and towards the primary shroud assembly 20. At least one, and preferably the upper engagement segment 42 is fixedly secured to the primary shroud assembly 20, thereby securing the primary shroud assembly 20 with the pivot brace 40. In the preferred embodiment, the primary shroud assembly 20 includes a fastener channel 29 defined by an upper region 28 of the primary shroud assembly 20. This fastener channel 29 is structured to receive the upper engagement segment 42 of the pivot brace 40 in slided relation therein. Moreover, the fastener channel 29 will preferably be sized so as to substantially correspond to the engagement segment 42 and be introduced therein and permit minimal spacing there between for external access. Further, although not absolutely necessary, in the embodiment illustrated, the lower engagement segment 44 is structured to extend beneath the primary shroud assembly 20 within a channel 26 disposed in parallel relation with the fastener channel 29. Accordingly, a more secure, clasped engagement between the pivot brace 40 and the primary shroud assembly 20 can be achieved.

Disposed in overlying relation with one another within at least the upper engagement segment 42 of the pivot brace 40 and the upper region 28 of the primary shroud assembly 20 that defines the fastener channel 29 are the corresponding receiving apertures 30 and 47. Specifically, the lock apertures 30 and 47 are structured and disposed to receive the elongate segment 11 therethrough in order to achieve secure, fastened interconnection between the pivot brace 40 and the primary shroud assembly 20. In this regard, it should be noted that the primary shroud assembly 20 need not include a specifically defined fastener channel 29, but rather the engagement segment 42 of the pivot brace 40 may merely overly the front face 21 of the primary shroud assembly 20 for secure engagement therebetween by the single elongate segment 11. Moreover, although the elongate segment 11 may extend through those receiving apertures 30 and 47 towards the second closure assembly 82', a preferred seal position of the elongate element 11 is defined by the corresponding lock segment 14 be nestled in the primary shroud assembly 20, with the second lock segment 15 disposed at the lock aperture 89 of the shielded closure assembly 82. As such, the lock segment can be effectively contained to prevent direct tampering therewith, with only the indicia being visible from the shroud assembly 20, if desired. Indeed, it is this single seal connection between a container lock and a closure assembly that achieves added security and integrity of the security system. For example, the lock segment can be positioned within the primary shroud such that even if the elongate segment is cut, the lock segment and a portion of the elongate segment will remain contained by the shroud and positioned within the receiving apertures to secure the container lock in place. Such also eliminates the need for separate seals or the tampering with only one seal without affecting the other sealed location.

From the previous description it can be seen that the primary shroud assembly 20 and the pivot brace 40 act together to maintain secure, protective interconnection over the connection joint 86. In particular, the encased engagement of the primary shroud assembly 20 about the actuation handle 85 and connection joint 86 prevent relative movement between the primary shroud assembly 20 or the pivot brace 40. Of course, however, a primary function of the pivot brace 40 is to resist pivotal movement of the primary shroud assembly 20 relative to an axis of the lock rod 84, and therefore pivotal movement of the actuation handle 85 and connection joint 86 into a door unlatching orientation. As specifically seen in the Figures, in order to prevent pivotal movement, the pivot brace 40 includes an outwardly depending flange 46. The outwardly depending flange 46 is structured to extend in a generally parallel, closely spaced relation with a surface of the door 81 of the cargo container 80. Accordingly, the flange 46 functions to prevent pivotal movement due to the fact that it will immediately abut the door 81 upon pivotal movement of the actuation handle 85 or the connection joint 86 which are encased by the primary shroud assembly 20.

Further, although as indicated the elongate segment 11 may extend across the doors and to the second closure assembly 82' to independently prevent opening of the doors, such positioning is not necessary, especially when a container lock is utilized. For example, in an embodiment of the tamper evident container door lock, an elongate cross brace 65 is provided. Specifically, the cross brace 65 is structured to securely engage the primary shroud assembly 20. Moreover, a first end of the cross brace 65 preferably includes a generally flat, planar configuration, and also includes a lock aperture defined therein. The lock aperture of the cross brace 65 is structured to be positioned in overlying relation with the lock aperture 47 on the pivot brace 40 and the lock aperture 30 on the primary shroud assembly 20. As such, the elongate segment 11 can extend simultaneously through all three lock apertures to secure the various elements with one another. Moreover, it is preferred that the fastener channel 29 be formed slightly larger than a thickness of the engagement member 42 of the pivot brace 40 so as to be structured to receive both the engagement member 42 of the pivot brace 40 and the first end of the cross brace 65 into slided relation therein, with minimal room for movement or exterior access remaining. Additionally, a second end of the cross brace 65 is secured with the lock rod 84' on the second door 81' such that the cross brace functions to prevent the doors from opening even if the lock rods are rotated to release the doors.

Lastly, the tamper evident cargo container door lock included in the present invention may also include tamper evident coating means. Specifically, the tamper evident coating is structured to completely cover and coat the primary shroud assembly 20, the pivot brace 40 and in the embodiment including the cross brace 65, the cross brace 65 as well, to provide structure to indicate if any element has been cut and subsequently welded or repaired. Specifically, the tamper evident coating is structured to provide each element with a substantially noticeable surface finish, which if cut through in order to remove the pivot brace 40 the cross brace 65 or the primary shroud assembly 20 will provide a positive, highly noticeable indication of tampering. In the preferred embodiment, the tamper evident coating includes a powder coated finish disposed on the primary shroud assembly 20, the pivot brace 40, and the cross brace 65. In particular, the powder coated finished is a specialized and difficult to duplicate surface coating that provides a rough, substantially randomized finish, which once cut through is very difficult to duplicate, especially in small portions at a remote location. Accordingly, if a thief enters the cargo container 80 by opening the rear doors 81 and 81' they must necessarily cut through all or part of the tamper evident cargo container door lock of the present invention, that cut making the powder coated finish visibly damaged especially if the segments are rewelded together after cargo has been removed and the doors 81 and 81' are re-closed. of course, if the elongate segment 11 is extended across the doors, it must also be cut, its multi-strand construction functioning to minimize the risk of un-noticeable replacement.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To securely close a container having at least one door, an improved cargo security assembly comprising:

a cargo container closure assembly structured to be positioned between an open orientation wherein the cargo door can be opened and a closed orientation wherein the cargo door is maintained closed, said cargo container closure assembly including a cargo container door latch assembly structured to restrict movement of said cargo container closure assembly into said open orientation when latched and including at least one lock aperture defined therein, a container door lock structured to be disposed on said cargo container closure assembly to prevent opening thereof and including a primary shroud assembly and a pivot brace, said primary shroud assembly structured to substantially shield from external access a connection joint between an actuation handle of the container door latch assembly and a lock rod of the cargo container closure assembly, said pivot brace structured to engage said primary shroud assembly and prevent pivotal movement thereof along with the actuation handle about an axis of the lock rod, at least one receiving aperture extending through both said primary shroud assembly and said pivot brace;

an elongate segment of substantially strong, generally flexible material and including a first end and a second end, one of said first and second ends extending through said one lock aperture and the other of said first and second ends extending through said one receiving aperture to define a sealed position of said elongate segment, a pair of lock segments each being mounted on a different one of said first and second ends and each having an increased diameter relative to a diameter of said elongate segment and a diameter of said lock and receiving apertures so as to prevent unauthorized removal of said elongate segment from either said container door lock or said cargo container door latch assembly, and said elongate segment cooperatively disposed and structured relative to both said cargo container door latch assembly and said container door lock to prevent removal thereof and movement of said cargo door latch assembly from said closed orientation to said open orientation unless said elongate segment is removed from said sealed position.

2. An improved cargo security assembly as recited in claim 1 wherein each of said lock segments includes an identifying indicia disposed thereon.

3. An improved cargo security assembly as recited in claim 2 wherein said identifying indicia on each of said lock segments is different from the other.

4. An improved cargo security assembly as recited in claim 1 wherein said container door lock further includes a tamper evident coating structured and disposed to cover said primary shroud assembly and said pivot brace, said tamper evident coating being substantially difficult to un-noticeably repair upon said primary shroud assembly or said pivot brace, and accordingly said tamper evident coating, being cut, thereby providing a clear, positive indication of tampering.

5. An improved cargo security assembly as recited in claim 1 wherein said primary shroud assembly is formed of a substantially strong, cut resistant material and is structured and disposed to prevent access to the connection joint without cutting or removing said primary shroud assembly, thereby restricting vertical movement of said primary shroud assembly relative to the lock rod.

6. An improved cargo security assembly as recited in claim 1 wherein one of said first and second ends of said elongate segment extending through said receiving aperture is disposed and structured to secure said primary shroud assembly to said pivot brace and prevent separation thereof without removal of said elongate element from said container door lock.

7. An improved cargo security assembly as recited in claim 1 wherein said sealed position of said elongate segment is further defined by said pivot brace being disposed about the lock rod and into engagement with said primary shroud assembly.

8. An improved cargo security assembly as recited in claim 7 wherein said pivot brace is structured to be removable from about the lock rod when said elongate segment is detached from said container door lock.

9. An improved cargo security assembly as recited in claim 7 wherein said sealed position of said elongate segment is further defined by said primary shroud assembly being disposed in secure engagement about the actuation handle and in covering relation to the connection joint.

10. An improved cargo security assembly as recited in claim 9 wherein said primary shroud assembly is structured to be removable from secure engagement about the actuation handle and covering relation to the connection joint when said elongate segment is detached from said container door lock.

11. An improved cargo security assembly as recited in claim 9 wherein said elongate segment is disposed and cooperatively structured with both said primary shroud assembly and said pivot brace to prevent separation thereof from one another and further prevent removal of said pivot brace relative to the lock rod and removal of the primary shroud assembly relative to the actuation handle without removal of said elongate segment from said sealed position.

12. An improved cargo security assembly as recited in claim 1 wherein said container door lock comprises a first receiving aperture formed in said primary shroud assembly and a second receiving aperture formed in said pivot brace, said elongate segment disposed to have one of said first and second ends extending through both said and second receiving apertures to secure said pivot brace to said first primary shroud assembly when said elongate segment is in said sealed position.

13. An improved cargo security assembly as recited in claim 1 wherein said container door lock is structured to be removable from said cargo container closure assembly upon detachment of said elongate segment from said container door lock.

14. To securely close a container having at least one door, an improved cargo security assembly comprising:

a cargo container closure assembly structured to be positioned between an open orientation wherein the cargo door can be opened and a closed orientation wherein the cargo door is maintained closed, said cargo container closure assembly including a cargo container door latch assembly structured to restrict movement of said cargo container closure assembly into said open orientation when latched and including at least one lock aperture defined therein, a container door lock structured to be disposed on said cargo container closure assembly in order to prevent opening thereof and including a primary shroud assembly and a pivot brace, said primary shroud assembly structured to substantially shield from external access a connection joint between an actuation handle of the container door latch assembly and a lock rod of the cargo container closure assembly, said pivot brace disposed about the lock rod and structured to engage said primary shroud assembly and prevent pivotal movement thereof along with the actuation handle about an axis of the lock rod, a first receiving aperture formed in said primary shroud assembly and a second receiving aperture formed in said pivot brace, an elongate segment of substantially strong, generally flexible material and including a first end and a second end, one of said first and second ends extendable through said one lock aperture and the other of said first and second ends extendable through said first and second receiving apertures to define a sealed position of said elongate segment, a pair of lock segments each mounted on a different one of said first and second ends and each having an increased diameter relative to a diameter of said elongate segment and a diameter of said lock aperture and said receiving apertures so as to prevent unauthorized removal of said elongate segment from either said container door lock or said cargo container door latch assembly, said container door lock being structured to be removable from said cargo container closure assembly upon detachment of said elongate segment from said container door lock, and said elongate segment disposed and cooperatively structured relative to both said cargo container door latch assembly and said container door lock to prevent removal thereof and movement of said cargo container door latch assembly from said closed orientation to said open orientation unless said elongate segment is removed from said sealed position.

* * * * *